US006796840B2

(12) United States Patent
Harada

(10) Patent No.: US 6,796,840 B2
(45) Date of Patent: Sep. 28, 2004

(54) SURFACE MOUNTING TYPE NON-REVERSIBLE CIRCUIT ELEMENT HAVING SUPERIOR PRODUCTIVITY

(75) Inventor: Hiroshi Harada, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 25 days.

(21) Appl. No.: 10/361,552

(22) Filed: Feb. 10, 2003

(65) Prior Publication Data

US 2003/0153211 A1 Aug. 14, 2003

(30) Foreign Application Priority Data

Feb. 14, 2002 (JP) ..... 2002-037079

(51) Int. Cl.[7] ..... H01R 13/66
(52) U.S. Cl. ..... 439/620; 439/38
(58) Field of Search ..... 439/620, 38

(56) References Cited

U.S. PATENT DOCUMENTS 6,042,385 A * 3/2000 Watanabe et al. ..... 439/38
6,086,422 A * 7/2000 Glynn ..... 439/620
6,174,203 B1 * 1/2001 Asao ..... 439/620
6,422,901 B1 * 7/2002 Belopolsky ..... 439/620
6,437,675 B1 * 8/2002 Chu ..... 439/38
6,467,165 B1 * 10/2002 Glynn ..... 439/620
6,527,594 B1 * 3/2003 Korsunsky et al. ..... 439/620
6,537,110 B1 * 3/2003 Korsunsky et al. ..... 439/620

FOREIGN PATENT DOCUMENTS

JP H10-242713 9/1998

* cited by examiner

*Primary Examiner*—Gary Paumen
(74) *Attorney, Agent, or Firm*—Brinks Hofer Gilson & Lione

(57) ABSTRACT

In a surface mounting type non-reversible circuit element, a supporting member is provided with a first yoke, while a plurality of terminal members made of a metal material are mounted on the supporting member 11. The terminal members own contact portions, and connection portions. The contact portions are made in contact to terminal portions of center electric conductors. The connection portions are exposed from a lower surface of the supporting member, and are located at the same surface as a lower surface of a second yoke. The terminal members can be surface-mounted in conjunction with the second yoke so as to improve productivity of the non-reversible circuit element, while assembling work thereof can be carried out in a simple manner.

7 Claims, 4 Drawing Sheets

SURFACE MOUNTING TYPE NON-REVERSIBLE CIRCUIT ELEMENT HAVING SUPERIOR PRODUCTIVITY

BACKGROUND OF THE INVENTION

1. Field of the Invention

The present invention is related to a surface mounting type non-reversible circuit element such as a circulator and an isolator, which is applied to an antenna commonly-using device and the like.

2. Description of the Related Art

A structure of a conventional non-reversible circuit element will now be explained with reference to FIG. 5. This conventional non-reversible circuit element is constituted by a first "clamp-shaped" yoke 51, a magnet 52, a ferrite member 53, three pieces of center electric conductors 54, a holding member 55, and a second "clamp-shaped" yoke 56. The magnet 52 is arranged within this first yoke 51. The ferrite member 53 is arranged at a lower portion of this magnet 52. The three center conductors 54 are made of metal plates, and are mounted on the ferrite member 53 in an interval defined by 120 degrees. Portions of these center conductors 54 are intersected with each other. The holding member 55 holds the ferrite member 53.

Also, the ferrite member 53 on which the center conductors 54 are mounted is inserted into a hole 55*a* of the holding member 55. Under such a condition that the magnet 52 is arranged on this ferrite member 55, the first yoke 51 and the second yoke 56 are employed so as to cover the magnet 52 and the ferrite member 55 along upper/lower directions.

Then, under such a state that the magnet 52, the ferrite member 53, and the holding member 55 are sandwiched by the first yoke 51 and the second yoke 56, the first yoke 51 is coupled to the second yoke 56, the clamp-shapes of which are alternately arranged, so that a magnetic closed circuit may be formed by the first yoke 51 and the second yoke 56.

Also, the center conductors 54 are made of thin metal plates, and are constructed in such a manner that terminal portions 54*a* formed at edge portions thereof are projected outwardly from the first yoke 51 and the second yoke 56.

In the case that such a non-reversible circuit element is assembled in an electronic appliance, the terminal portions 54*a* of the center conductors 54 are wired by employing wire lines.

Since the terminal portions 54*a* of the center conductors 54 are wired by employing the wire lines in the conventional non-reversible circuit element, there is a problem that cumbersome works are necessarily required.

Also, since the magnet 52 is simply placed inside the first yoke 51, there is a problem that the mounting position of the magnet 52 is fluctuated.

Then, the conventional non-reversible circuit element owns another problem that since the mounting position of the magnet 52 is fluctuated, constant performance of this conventional non-reversible circuit cannot be achieved, and thus, qualities thereof are deteriorated.

SUMMARY OF THE INVENTION

The present invention has been made to solve the above-described problems of the prior art, and therefore, has an object to provide a surface mounting type non-reversible circuit element having superior qualities, the assembling work of which can be simply carried out, while a mounting position of a magnet is made stable.

As a first solving means capable of solving the above-described conventional problems, a surface mounting type non-reversible circuit element is arranged by comprising: a flat-plate-shaped ferrite member; first, second, and third center electric conductors which are located on the ferrite member, and are provided on different surfaces along upper/lower directions while sandwiching a dielectric substance, portions of which are intersected to each other along the upper/lower direction; a magnet arranged on the first, second, and third center electric conductors; a first yoke arranged in such a manner that the first yoke covers the magnet; and a second yoke which is arranged on the side of a lower surface of the ferrite member, and constitutes a magnetic closed circuit in combination with the first yoke; in which a supporting member on which a plurality of terminal members made of a metal material are mounted is provided with the first yoke; and the terminal members own contact portions which are made in contact to the terminal portions of the first, second, third center electric conductors; and connection portions which are exposed from a lower surface of the supporting member and whose surfaces are located at the same surface as the lower surface of the second yoke.

Also, as a second solving means, the surface mounting type non-reversible circuit element is arranged by that the non-reversible circuit element is further comprised of a chip type capacitor having first and second electrode portions which are located opposite to each other while sandwiching therebetween an insulating member; the first electrode portion is put on a bottom plate of the second yoke so as to be mounted on the bottom plate, the terminal portions of the center conductors are connected onto the second electrode portion, and the contact portions of the terminal members are made in contact with the terminal portions of the center conductors which are located over the second electrode portion.

Also, as a third solving means, the surface mounting type non-reversible circuit element is arranged by that positioning of the magnet is performed by the supporting member.

Also, as a fourth solving means, the surface mounting type non-reversible circuit element is arranged by that the supporting member is formed with the first yoke in an integral body by way of a molding process operation.

Also, as a fifth solving means, the surface mounting type non-reversible circuit element is arranged by that the terminal member is made of a metal material having an elastic characteristic.

Also, as a sixth solving means, the surface mounting type non-reversible circuit element is arranged by that the terminal member is embedded in the supporting member by way of a molding process operation so as to be mounted thereon.

Also, as a seventh solving means, the surface mounting type non-reversible circuit element is arranged by that a bent portion of the terminal member provided at one end of the connection portion is arranged under such a condition that the bent portion is exposed from a side surface of the supporting member.

BRIEF DESCRIPTION OF THE DRAWINGS

For a better understanding of the present invention, reference is made of a detailed description to be read in conjunction with the accompanying drawings, in which.

DETAILED DESCRIPTION OF THE PREFERRED EMBODIMENTS

Figure 1:
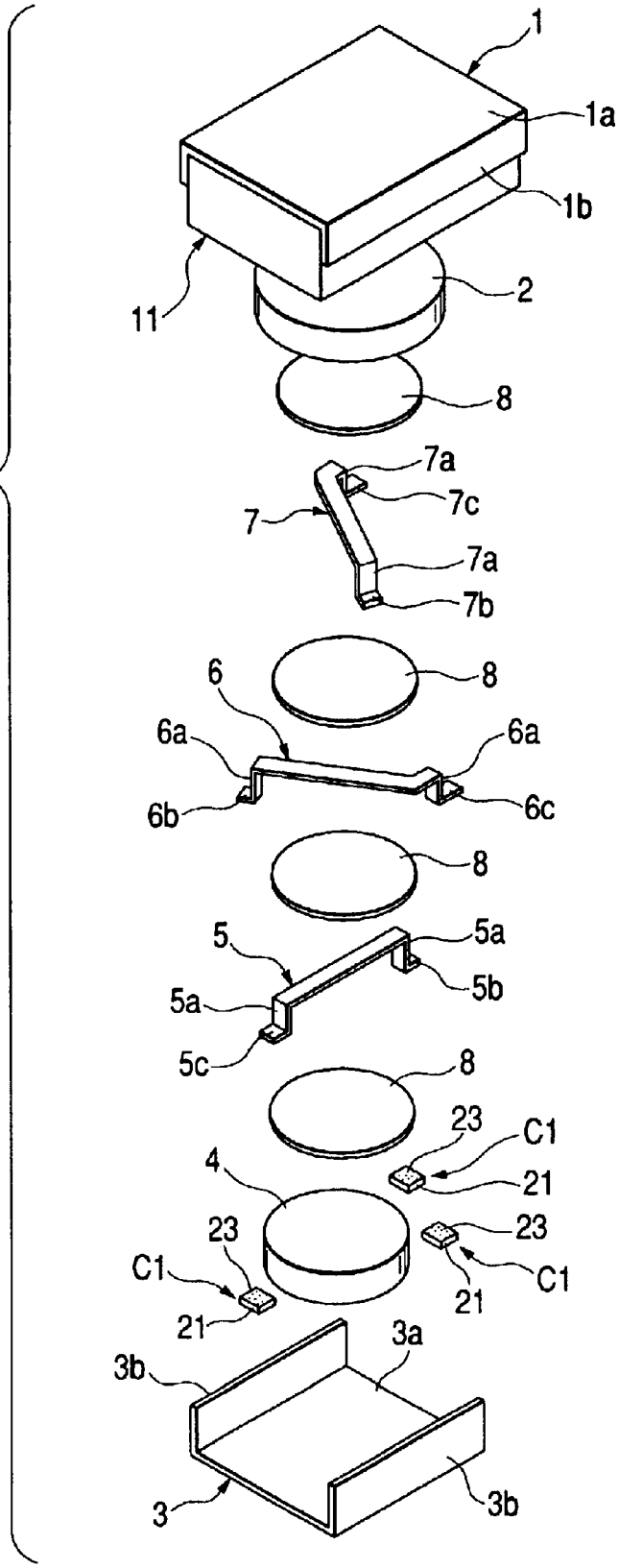
FIG. 1 is an exploded perspective view for indicating a surface mounting type non-reversible circuit element according to the present invention.
Figure 2:
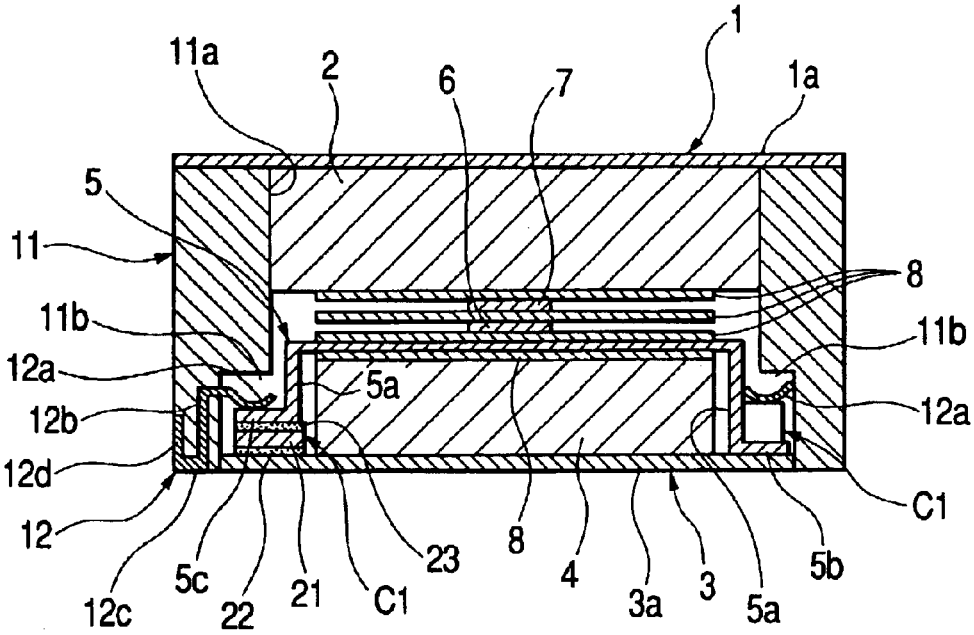
FIG. 2 is a sectional view for representing a major portion of the surface mounting type non-reversible circuit element according to the present invention.
Figure 3:
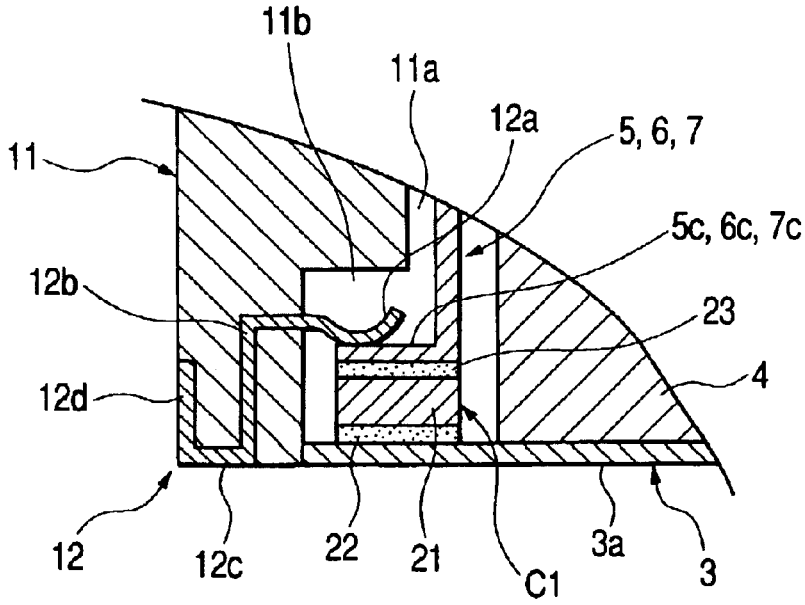
FIG. 3 is an enlarged sectional view for showing the major portion of the surface mounting type non-reversible circuit element according to the present invention.
Figure 4:
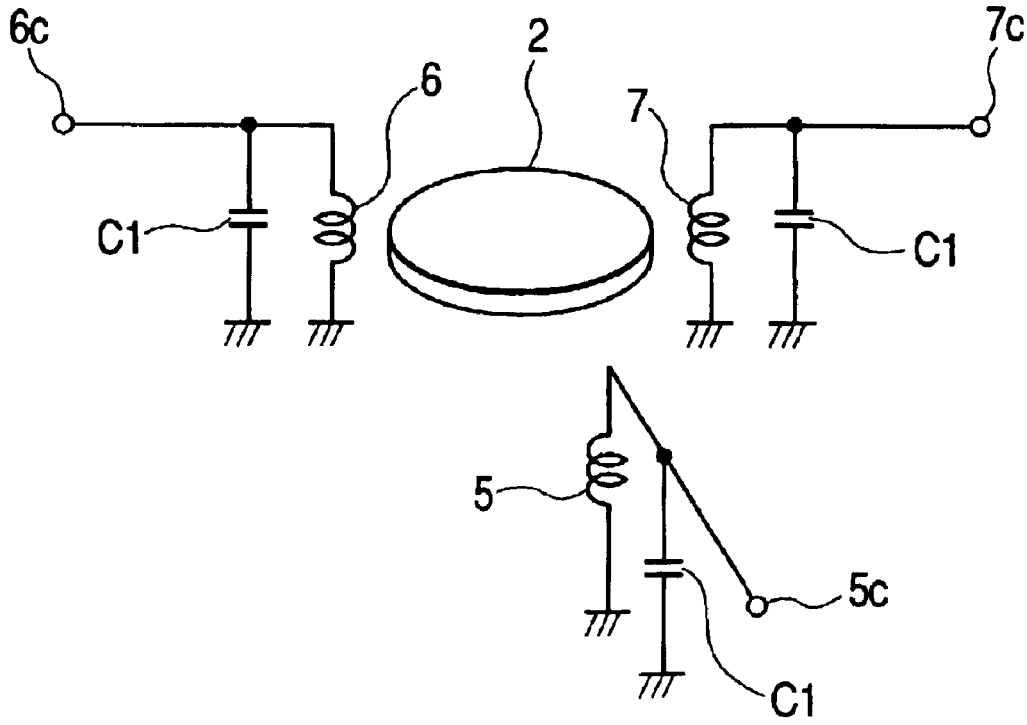
FIG. 4 is an equivalent circuit diagram of a circulator to which the surface mounting type non-reversible circuit element of the present invention is applied.
Figure 5:
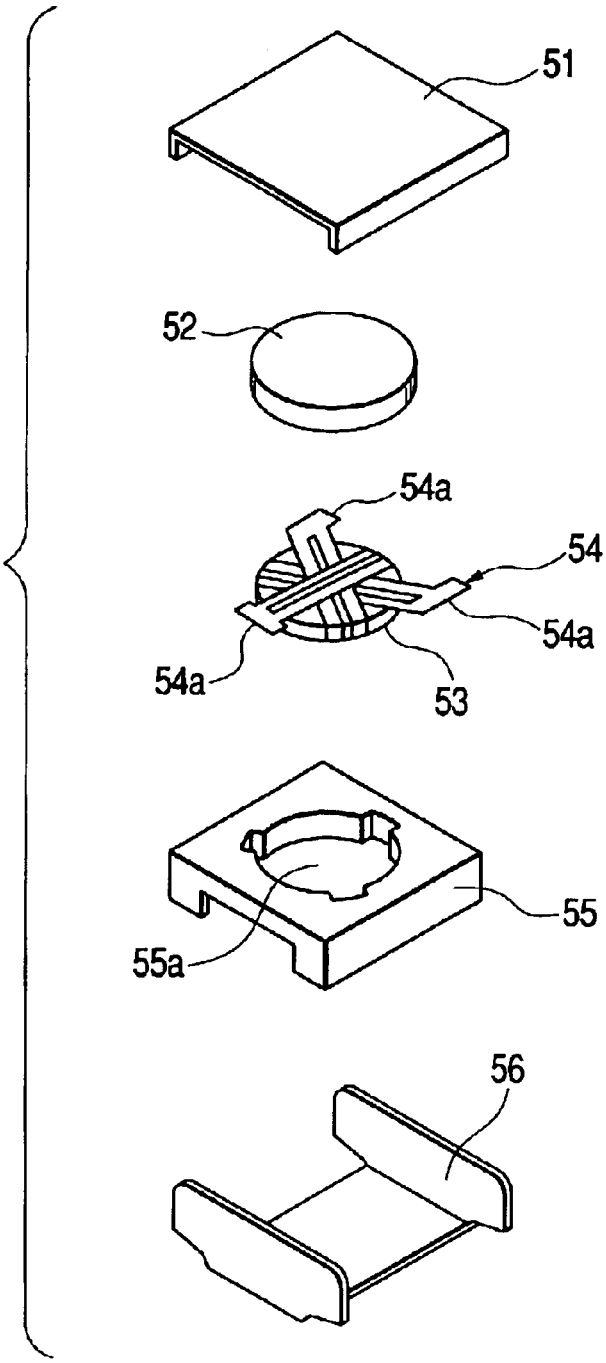
FIG. 5 PRIOR ART
FIG. 5 is an exploded perspective view for indicating the conventional non-reversible circuit element.

Referring now to drawings, various embodiment modes of the present invention will be described. That is, FIG. 1 is an exploded perspective view for indicating a surface mounting type non-reversible circuit element according to the present invention, and FIG. 2 is a sectional view for representing a major portion of the surface mounting type non-reversible circuit element according to the present invention. Also, FIG. 3 is an enlarged sectional view for showing the major portion of the surface mounting type non-reversible circuit element according to the present invention, and FIG. 4 is an equivalent circuit diagram of a circulator to which the surface mounting type non-reversible circuit element of the present invention is applied.

Next, a construction of the surface mounting type non-reversible circuit element according to the present invention will now be explained based upon FIG. 1 to FIG. 3. A first yoke 1 made of a "clamp-shaped" magnetic plate (iron plate etc.) owns an upper plate 1*a* having a rectangular shape, and one pair of side plates 1*b*. The paired side plates 1*b* are bent from an edge located opposite to this upper plate 1*a* along a lower direction, and are located opposite to each other.

A rectangular-parallelepiped supporting member 11 made of a synthetic resin molding product is constituted by either two members separated from each other or a single member. This supporting member 11 contains a cylindrical cavity portion 11*a*, and a notch portion 11*b*. The cylindrical cavity portion 11*a* is provided at a center portion of this supporting member 11. The notch portion 11*b* is provided on the side of a lower portion of this cavity portion 11*a*.

Then, this supporting member 11 is mounted within the first yoke 1, and also, the supporting member 11 is formed with the first yoke 1 in an integral form by way of a molding process operation.

A terminal member 12 which is made of a metal member having an elastic characteristic owns a contact portion 12*a*, a connection portion 12*c*, and a bent portion 12*d*. The connection portion 12*c* is coupled via a coupling portion 12*b* to the contact portion 12*a*. The bent portion 12*d* is bent from one edge of this connection portion 12*c*.

A plurality of terminal members 12 are mounted on a lower portion of the supporting member 11 in such a manner that these terminal members 12 are embedded therein by way of a molding process operation. In the case that this terminal member 12 is mounted on the supporting member 11, the contact portion 12*a* is arranged in such a manner that this contact portion 12*a* is extended from the position of the notch portion 11*b* along a center direction. Also, the connection portion 12*c* is exposed from a lower surface of the supporting member 11, and further, the bent portion 12*d* is arranged under such a condition that this bent portion 12*d* is exposed from a side surface of the supporting member 11.

A disk-shaped magnet 2 is arranged in such a manner that this magnet 2 is inserted into the cavity portion 11*a* of the supporting member 11. An outer peripheral surface of this magnet 2 is supported by the supporting member 11 so as to be positioned.

A second yoke 3 which is made of a "clamp-shaped" magnetic plate (iron plate etc.) has a rectangular-shaped bottom plate 3*a*, and one pair of side plates 3*b*. The paired side plates 3*b* are bent from edges of this bottom plate 3*a*, which are located opposite to each other along an upper direction, and are located opposite to each other.

Then, this second yoke 3 is set under such a condition that one pair of these side plates 3*b* are coupled to one pair of these side plates 1*b* of the first yoke 1, so that a magnetic closed circuit may be formed, and also, the supporting member 11 is located within the second yoke 3.

A flat-plate-shaped ferrite member 4 which is made of YIG (Yttrium Iron Garnet) and the like is mounted under such a condition that this ferrite member 4 is put on the bottom plate 3*a* of the second yoke 3.

Also, a chip type capacitor "C1" is constructed of an insulating member 21, a first electrode portion 22, and a second electrode portion 23. The insulating member 21 is made of a plate-shaped ceramic and the like. Both the first electrode portion 22 and the second electrode portion 23 are made of silver and the like, and are formed on two flat outer surfaces of this insulating member 21. The two-flat outer surfaces are located opposite to each other. Then, a capacitance is formed between the first electrode portion 22 and the second electrode portion 23 located opposite to each other.

Then, three pieces of these chip type capacitors C1 are arranged in such a manner that the first electrode portion 22 is soldered to the bottom plate 3*a* of the second yoke 3 so as to be mounted on this second yoke 3, and also to be grounded to the second yoke 3.

First, second, and third center electric conductors 5, 6, and 7, which are constructed of thin electric-conductive plates made of copper and the like, own one pair of bent portions 5*a*, 6*a*, 7*a*; connection portions 5*b*, 6*b*, 7*b*; and terminal portions 6*c*, 6*c*, 7*c*, respectively. Each of the paired bent portions 5*a*, 6*a*, and 7*a* is provided on each of both edge portions of the first, second, and third center conductors 5, 6, 7. The connection portions 5*b*, 6*b*, 7*b* are provided at edge portions of one bent portions 5*a*, 6*a*, 7*a*. The terminal portions 5*c*, 6*c*, and 7*c* are bent at edge portions of the other bent portions 5*a*, 6*a*, 7*a*.

Then, the first, second, and third center conductors 5, 6, 7 are arranged on different surfaces of dielectric substances 8 along upper/lower directions, while the dielectric substances 8 are made of insulating materials and are sandwiched by the first, second, and third center conductors 5, 6, and 7. Furthermore, these first, second, and third center conductors 5, 6, and 7 are arranged in such a manner that these center conductors 5, 6, 7 are separated from each other in an interval of 120 degrees, and also are partially intersected to each other along the upper/lower direction.

Also, these first, second, and third center conductors 5, 6, and 7 are mounted via the dielectric substances 8 on a ferrite member 4.

At this time, each of the terminal portions 5*c*, 6*c*, 7*c* of the first, second, and third center conductors 5, 6, 7 is soldered on the second electrode portion 23 of the chip type capacitor C1 so as to be electrically connected to this second electrode portion 23. Also, the connection portions 5*b*, 6*b*, and 7*b* are soldered to a bottom plate 3*a* of the second yoke 3 so as to be electrically connected to this bottom plate 3*a* under grounded condition.

In such a case that the first yoke 1 on which a base member 11 is mounted is combined with the second yoke 3 for holding the first, second, third center conductors 5, 6, 7, so that the first, second, third center conductors 5, 6, 7 are assembled, the contact portion 12*a* of the terminal member 12 is made in contact with the terminal portions 5*c*, 6*c*, 7*c* which are positioned over the second electrode portion 23 under elastic contact condition.

At this time, a lower surface of the connection portion 12*c* of the terminal member 12 is brought into such a condition that this lower surface is located at the substantially same plane with respect to a lower surface of the bottom plate 3*a* of the second yoke 3.

Then, the magnet 2 positioned to the first yoke 1 is arranged on the first, second, third center conductors 5, 6, 7. Under this condition, when the side plate 1*b* of the first yoke 1 is coupled to the side plate 3*b* of the second yoke 3, if the magnet 2, the ferrite member 4, and the like are sandwiched between the first yoke 1 and the second yoke 3, then a non-reversible circuit element constructed of either a circulator or an isolator is formed.

Also, the non-reversible circuit element having such a construction is mounted on a circuit board having an electric conductive pattern (not shown in this drawing), and thus, is surface-mounted on this circuit board.

Then, when the non-reversible circuit element is mounted, both the lower surface of the bottom plate 3*a* of the second yoke 3 and the lower surface of the connection portion 12*c* of the terminal member 12 are mounted and soldered on the circuit board under surface coincident condition. The connection portion 12*c* is soldered to a wiring conductive pattern, and the bottom plate 3*a* of the second yoke 3 is soldered to a grounding electric conductive pattern.

At this time, since the terminal member 12 is soldered to the bent portion 12*d* under exposure condition in connection with the connection portion 12*c*, this terminal member 12 can be firmly soldered to the conductive pattern.

Next, a structure of a surface mounting type non-reversible circuit element according to a second embodiment of the present invention will now be explained with reference to FIG. 4. In this non-reversible circuit element of the second embodiment, convex portions 5*d*, 6*d*, 7*d* are provided at the terminal portions 5*c*, 6*c*, 7*c*, of the first, second, third center conductors 5, 6, 7. The convex portions 5*d*, 6*d*, 7*d* have rounded portions which are projected toward the down direction.

Also, FIG. 4 indicates an equivalent circuit diagram in the case that the non-reversible circuit element of the present invention is applied to a circulator. In this drawing, the terminal portions 5*c*, 6*c*, 7*c*, which constitute input/output terminals are provided on the one edge side of each of the first, second, third center conductors 5, 6, 7. Also, the connection portions 5*b*, 6*b*, 7*b* are grounded which constitute the other edge sides of the first, second, third center conductors 5, 6, 7. Furthermore, the grounded chip type capacitor C1 is connected to the terminal portions 5*c*, 6*c*, 7*c* of the first, second, third center conductors 5, 6, 7.

As previously described in detail, the surface mounting type non-reversible circuit element, according to the present invention, is arranged by comprising: the flat-plate-shaped ferrite member; the first, second, and third center electric conductors which are located on the ferrite member, and are provided on the different surfaces along upper/lower directions while sandwiching the dielectric substance, the portions of which are intersected to each other along the upper/lower direction; the magnet arranged on the first, second, and third center electric conductors; the first yoke arranged in such a manner that the first yoke covers the magnet; and the second yoke which is arranged on the side of the lower surface of the ferrite member, and constitutes the magnetic closed circuit in combination with the first yoke; in which the supporting member on which a plurality of terminal members made of the metal material are mounted is provided with the first yoke; and the terminal members own the contact portions which are made in contact to the terminal portions of the first, second, third center electric conductors; and the connection portions which are exposed from the lower surface of the supporting member and whose surfaces are located at the same surface as the lower surface of the second yoke.

Since, such a structure of the surface mounting type non-reversible circuit element is employed, the terminal members 12 can be surface-mounted in conjunction with the second yoke. As a result, the assembling work of the surface mounting type non-reversible circuit element according to the present invention can be carried out in a simpler manner and this non-reversible circuit element can own superior productivity, as compared with those of the conventional non-reversible circuit element.

Also, when the first yoke is assembled with the second yoke, the contact portions of the terminal portions can be made in contact with the terminal portions of the center conductors, and thus, the superior assembling characteristic thereof can be achieved and furthermore, the terminal members are supported by the supporting member. As a consequence, the terminal members can be firmly supported and can be surface-mounted in conjunction with the second yoke under better condition.

Also, the above-described surface mounting type non-reversible circuit element is further provided with the chip type capacitor having the first and second electrode portions which are located opposite to each other while sandwiching therebetween the insulating member; the first electrode portion is put on the bottom plate of the second yoke so as to be mounted on the bottom plate, the terminal portions of the center conductors are connected onto the second electrode portion, and the contact portions of the terminal members are made in contact with the terminal portions of the center conductors which are located over the second electrode portion. As a consequence, the terminal portions of the center conductors can be supported in further strong force, so that these terminal portions can be made in contact to the contact portions under better condition.

Also, since the chip type capacitor is stored in the second yoke, the non-reversible circuit element can be made compact.

Also, since positioning of the magnet is carried out by the supporting member, the mounting position of the magnet can become stable and also can become constant, so that the non-reversible circuit element having the better quality can be provided.

Also, since the supporting member can own both the supporting function of the terminal portions and the positioning function of the magnet, a total number of the structural components of the non-reversible circuit element can be reduced and this non-reversible circuit element can be made in low cost.

Also, since the supporting member is formed with the first yoke in the integral form by way of the molding process operation, the supporting member can be tightly mounted on the first yoke, and also, the non-reversible circuit element can have the superior assembling characteristic.

Also, since the terminal members are made of the metal material having the elastic characteristic, the terminal members can be made in contact to the terminal portions under better conditions.

Also, since the terminal members are embedded in the supporting member by way of the molding process operation to be mounted thereon, the terminal members can be simply mounted under the strong strength.

Also, since the bent portions provided with the one edges of the connection portions of the terminal members are arranged under such a condition that these bent portions are exposed to the side surface of the supporting member, the terminal members can be firmly soldered.

What is claimed is:

1. A surface mounting type non-reversible circuit element comprising:

a flat-plate-shaped ferrite member;

first, second, and third center electric conductors which are located on said ferrite member, and are provided on different surfaces along upper/lower directions while sandwiching a dielectric substance, portions of which are intersected to each other along the upper/lower direction;

a magnet arranged on said first, second, and third center electric conductors;

a first yoke arranged such that said first yoke covers said magnet; and a second yoke which is arranged on a side of a lower surface of said ferrite member, and constitutes a magnetic closed circuit in combination with said first yoke; wherein:

a supporting member on which a plurality of terminal members made of a metal material are mounted is provided with said first yoke; and said terminal members have contact portions which contact terminal portions of said first, second, third center electric conductors; and connection portions which are exposed from a lower surface of said supporting member and whose surfaces are located at the same surface as a lower surface of said second yoke.

2. A surface mounting type non-reversible circuit element as claimed in claim 1 wherein:

said non-reversible circuit element is further comprised of a chip type capacitor having first and second electrode portions which are located opposite to each other while sandwiching therebetween an insulating member;

said first electrode portion is disposed on a bottom plate of said second yoke so as to be mounted on said bottom plate, said terminal portions of said center conductors are connected onto said second electrode portion, and said contact portions of said terminal members contact said terminal portions of said center conductors which are located over said second electrode portion.

3. A surface mounting type non-reversible circuit element as claimed in claim 1 wherein:

positioning of said magnet is performed by said supporting member.

4. A surface mounting type non-reversible circuit element as claimed in claim 1 wherein:

said supporting member is formed with said first yoke in an integral body by way of a molding process operation.

5. A surface mounting type non-reversible circuit element as claimed in claim 1 wherein:

said terminal member is made of a metal material having an elastic characteristic.

6. A surface mounting type non-reversible circuit element as claimed in claim 5 wherein:

said terminal member is embedded in said supporting member by way of a molding process operation so as to be mounted thereon.

7. A surface mounting type non-reversible circuit element as claimed in claim 5 wherein:

a bent portion of said terminal member provided at one end of said connection portion is arranged such that said bent portion is exposed from a side surface of said supporting member.

* * * * *